United States Patent [19]

Beavis et al.

[11] Patent Number: 4,856,483

[45] Date of Patent: Aug. 15, 1989

[54] VACUUM BLEED AND FLOW RESTRICTOR FITTING FOR FUEL INJECTED ENGINES WITH VAPOR SEPARATOR

[75] Inventors: Glenn C. Beavis; Robert J. Hensel, both of Oshkosh, Wis.

[73] Assignee: Brunswick Corporation, Skokie, Ill.

[21] Appl. No.: 140,438

[22] Filed: Jan. 4, 1988

[51] Int. Cl.[4] ..... F02M 39/00

[52] U.S. Cl. ..... 123/516; 123/510; 123/520

[58] Field of Search ..... 123/516, 514, 510, 512, 123/518, 519, 520, 521, 73 A

[56] References Cited

U.S. PATENT DOCUMENTS

| | | | |
|---|---|---|---|
| 1,490,581 | 4/1924 | Bell | 123/518 |
| 2,222,274 | 11/1970 | Antonusen | 123/516 |
| 3,548,796 | 12/1970 | Gastinne | 123/510 |
| 3,617,034 | 11/1971 | Skinner | 123/518 |
| 4,043,304 | 8/1977 | Stumpp | 123/510 |
| 4,205,648 | 6/1980 | Graham | 123/512 |
| 4,475,522 | 10/1984 | Oonaka | 123/520 |
| 4,590,897 | 5/1986 | Hundertmark | 123/73 A |
| 4,699,109 | 10/1987 | Hensel | 123/458 |

*Primary Examiner*—Carl Stuart Miller

*Attorney, Agent, or Firm*—Andrus, Sceales, Starke & Sawall

[57] ABSTRACT

In a marine fuel system for a fuel injected internal combustion engine, a fitting (50) is provided in the vapor supply line (41). The fitting (50) has a first reduced diameter passage (57) providing a vacuum bleed orifice passage partially venting vacuum from the induction manifold (17) to atmosphere, to limit peak vacuum applied to the vapor separator (33) from the induction manifold (17). The fitting (50) has a second reduced diameter passage (56) providing a flow restrictor passage limiting the volume of flow of fuel vapor from the vapor separator (33) to the induction manifold (17). The fitting (50) limits fuel vapor supplied from the vapor separator (33) to the induction manifold (17) at peak vacuum from the induction manifold (17) during rapid engine deceleration to prevent an overly rich fuel air mixture in the induction manifold (17) otherwise causing rough idling or stalling. The fitting (50) also solves hot restart problems. Another modification is provided by a one-way check valve (60) permitting only one-way flow of fuel from the vapor separator (33) to the high pressure fuel injection pump (25).

5 Claims, 1 Drawing Sheet

VACUUM BLEED AND FLOW RESTRICTOR FITTING FOR FUEL INJECTED ENGINES WITH VAPOR SEPARATOR

BACKGROUND AND SUMMARY

The invention relates to a marine fuel system for a fuel injected engine, and more particularly to the fuel vapor supply from a vapor separator. The invention arose during development efforts directed to solving hot restart problems in fuel injected marine internal combustion engines.

In fuel injected engines, it is important to accurately control the quantity of fuel delivered to the engine through the fuel injectors. Many systems have been designed to control the operation of a fuel injector to accurately meter the fuel to the engine. It is common to use a high pressure pump to supply fuel to the injectors with a pressure regulator providing an essentially constant fuel pressure at the injector. Excess fuel, i.e. the amount over and above that required by the engine, is recirculated back to the fuel tank. In marine applications where the fuel tank is located at significant distances from the engine, it is undesirable to provide an extended fuel return line to the fuel tank, since fire or other hazards could arise.

Some prior systems have used recirculating type fuel injection pumps with the excess fuel returning immediately to the inlet of the pump. In such systems, however, if the engine is operated at idle or low speeds for significant periods of time, the recirculating fuel accumulates heat from the pump and may vaporize. This typically would reduce the output of the pump to such a degree that adequate fuel pressure could no longer be maintained at the fuel injector.

It is known in the prior art to solve the above noted fuel vaporization problem by providing a fuel vapor separator. A first fuel pump draws fuel from the fuel tank, a second fuel pump receives fuel from the first pump and provides fuel under pressure to the fuel injector. A vapor separator is connected between the first and second pumps to remove fuel vapors from the fuel supplied to the second pump.

It has been found that even with a vapor separator, hot restart problems may still occur. It has also been found that upon rapid or snap engine deceleration, the engine may idle rough or stall. The present invention addresses and solves these problems.

It has been found that fuel foaming in the vapor separator spills into the inlet manifold of the induction system under high vacuum conditions. It has also been found that after turn-off of the engine, engine heat causes saturated fuel vapor to accumulate in the vapor separator which flows to the inlet manifold.

In the present invention, a fitting is provided in the vapor supply line and limits fuel vapor supplied from the vapor separator to the induction system at peak vacuum from the induction system during rapid engine deceleration. This prevents an overly rich fuel-air mixture in the induction system otherwise causing rough idling or stalling.

The fitting includes a vacuum bleed orifice passage partially venting vacuum from the induction system to atmosphere, to limit the peak vacuum applied to the vapor separator. The lower vacuum reduces boiling and vapor bubbles in the vapor separator. The fitting also includes a flow restrictor passage limiting the volume of flow of fuel vapor from the vapor separator to the induction system. The elimination of the overly rich mixture from the vapor separator to the induction system also solves the above noted hot restart problem.

DESCRIPTION OF PRIOR ART

Figure 1:
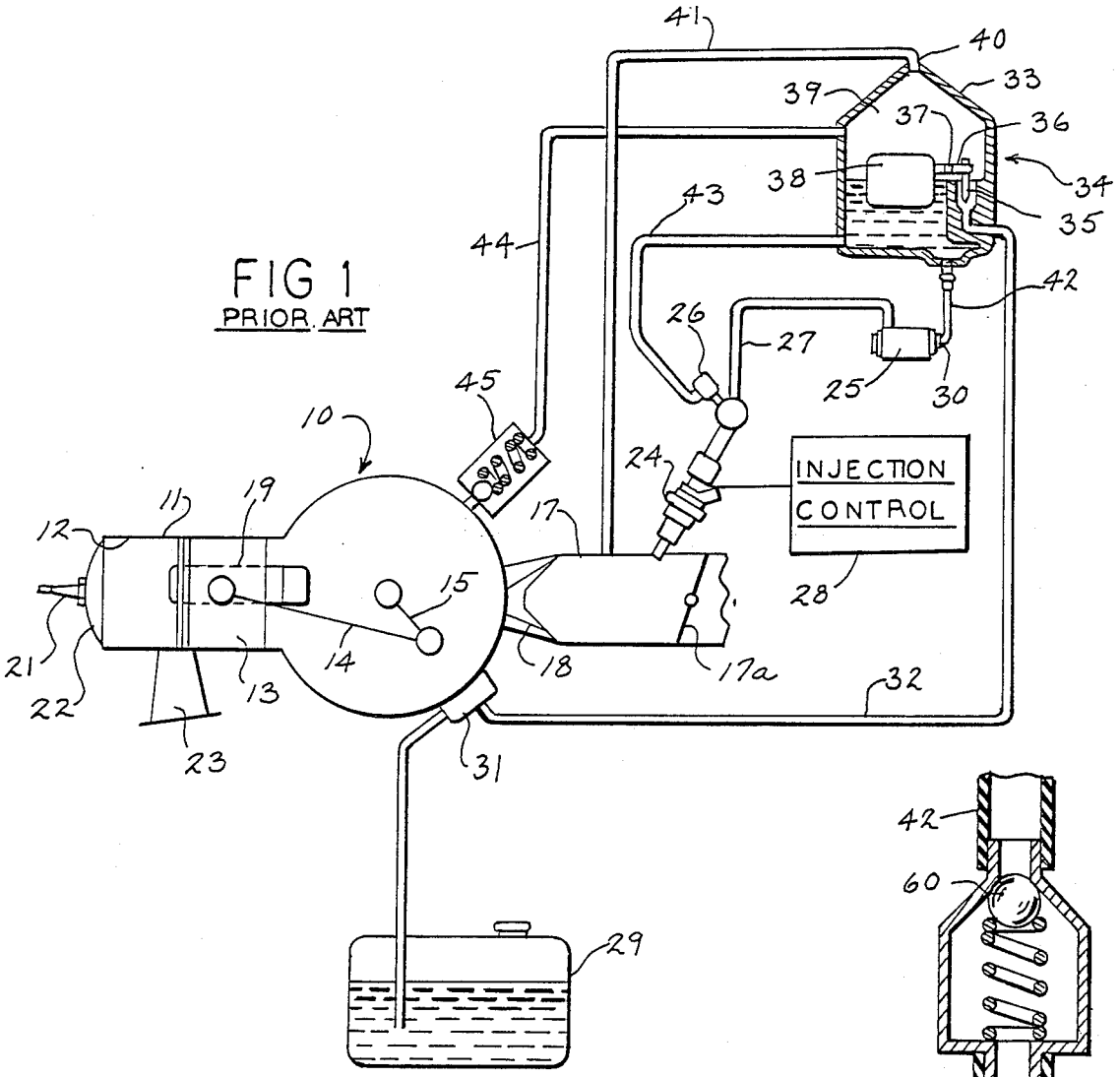
FIG 1 PRIOR ART
FIG. 1 schematically illustrates a marine fuel system for a fuel injected engine, as known in the prior art.

FIG. 1 shows one cylinder of a two cycle crankcase compression internal combustion engine 10. The engine includes a cylinder block 11 having a cylinder bore 12 in which a piston 13 is supported for reciprocation. The piston 13 is connected by connecting rod 14 to crankshaft 15 which is journaled for rotation in crankcase 16 of engine 10. The engine includes an induction system with air intake manifold 17 having throttle valve 17a and supplying air to crankcase 16. One-way reed check valve 18 permits flow from manifold 17 into crankcase 16, and prevents reverse flow out of crankcase 16 into manifold 17. A transfer passage 19 extends from crankcase 16 through cylinder block 11 and terminates at an inlet port 20 in the cylinder wall at a point above the bottom dead center position of piston 13. A spark plug 21 is provided in the cylinder head 22 for firing the fuelair charge. An exhaust port 23 is formed in cylinder bore 12 to discharge exhaust gases to the atmosphere.

Engine 10 is provided with a fuel injection system that includes an electromagnetically controlled injection nozzle 24 that discharges into induction manifold 17. Fuel, typically gasoline, is supplied to nozzle 24 by a high pressure fuel pump 25. A pressure regulator 26 is provided on the fuel supply line 27 to maintain an essentially constant fuel pressure at fuel injection nozzle 24. An electronic controller 28 is provided to control the operation of injection nozzle 24 in known manner to deliver the desired amount of fuel to induction manifold 17 at the desired times.

During running of the engine, air is delivered to induction manifold 17 and fuel is injected by nozzle 24 to provide a fuel-air mixture which is admitted to crankcase 16 through reed valve 18 while piston 13 is moving upwardly toward spark plug 21. Reed valve 18 will open during these conditions as long as the pressure in crankcase 16 is lower than that in induction manifold 17. As piston 13 moves downwardly toward crankcase 16, exhaust port 23 will open to discharge spent combustion products, and intake port 20 will open to allow transfer of fuel-air mixture from crankcase 16 to cylinder 12. On the upstroke of piston 13, spark plug 21 is fired to ignite the mixture, and the cycle continues in conventional manner.

A vapor free supply of fuel from a remote fuel tank 29 is provided to the inlet 30 of high pressure fuel pump 25. A low pressure fuel pump 31, such as diaphragm pump operated by the pulsating pressure in the engine's crankcase 16, is used to draw fuel from remote fuel tank 29. Such diaphragm pumps are commonly used on outboard motors and produce a fuel output closely matched to engine requirements. From the lower pressure pump 31 fuel is supplied by a fuel line 32 to a vapor separator 33. Admission of fuel from low pressure pump 31 to vapor separator 33 is controlled by a float operated valve 34. The valve member 35 is controlled by a lever 36 having a pivot point 37 fixed on the vapor separator 33 and attached to a float 38. The level of fuel in the vapor separator chamber 39 is thus controlled by the float operated valve 34. An opening 40 at the top of vapor separator chamber 39 is connected by a line 41 to induction manifold 17. The inlet 30 of high pressure fuel pump 25 is connected by fuel line 42 to draw fuel from the bottom of the vapor separator chamber 39, and a return line 43 from pressure regulator 26 returns excess fuel to the vapor separator chamber 39. A line 44 is connected from crankcase 16 to vapor separator 33 for recirculation of heavy fuel ends. During the compression stroke of piston 13 away from spark plug 21, the heavy fuel ends are pumped from crankcase 16 through one-way check valve 45 to vapor separator 33 for recirculation. Valve 45 prevents reverse flow through line 44 back into crankcase 16.

In operation, low pressure fuel pump 31 supplies fuel to vapor separator 33 through float controlled valve 34. The pressure in separator 33 at the surface of the fuel will be held at or below atmospheric pressure by the connection through line 41 to induction manifold 17. Thus, fuel which vaporizes will be drawn from separator 33 and supplied through line 41 to induction manifold 17. Hence, vapor free fuel will be supplied through line 42 to inlet 30 of high pressure fuel injection pump 25. Separator 33 is also effective to remove vapors from the fuel returned to separator 33 from pressure regulator 26 through line 43 and from crankcase 16 through line 44.

DESCRIPTION OF THE INVENTION

The present invention involves modifications of the system shown in FIG. 1 and arose during development efforts in connection with a Mercury Marine V-220 fuel injected engine mounted to a 20 foot Concord boat using a 21 pitch propeller.

Figure 2:
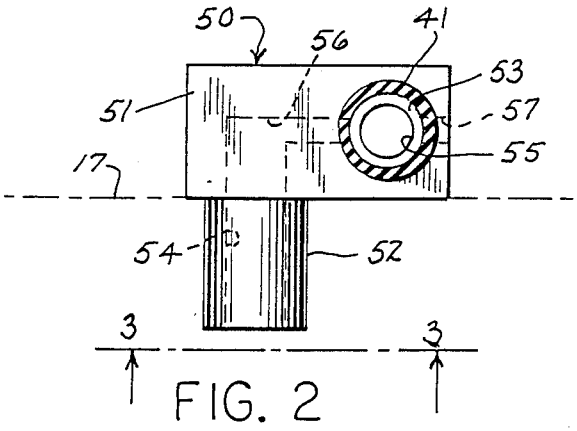
FIG. 2 shows a fitting in accordance with the invention for the system of FIG. 1.
Figure 3:
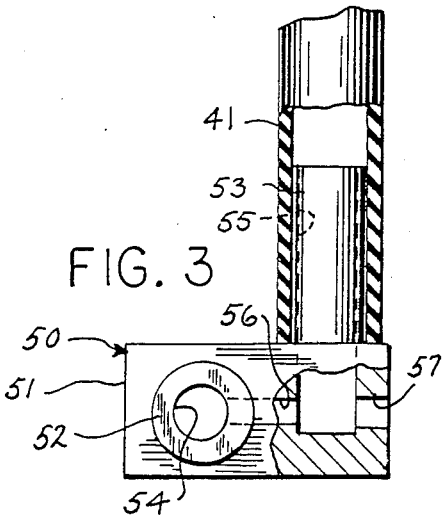
FIG. 3 is a view taken along line 3—3 of FIG. 2.

A brass fitting 50, FIGS. 2 and 3, has a central body portion 51 with a first projecting stud 52 press fit into aluminum intake manifold 17 of the above noted V-220 engine, and a second projecting stud 53 to which the end of vapor supply line rubber hose 41 is connected. Studs 52 and 53 have internal bores 54 and 55, respectively, communicating with a central passage 56 in body portion 51. Central body portion 51 has another passage 57 coaxial with passage 56 and axially offset and spaced from passage 56 by passage 55. Passage 57 is vented to atmosphere. Passages 56 and 57 have reduced diameters as compared to bores 54 and 55 and hose 41. Bore 54 has an inner diameter of 0.135 inch. Bore 55 has an inner diameter of 0.130 inch. Passage 56 has an inner diameter 0.052 inch. Passage 57 has an inner diameter of 0.070 inch. Hose 41 has an inner diameter of 0.175 inch.

Passage 57 provides a vacuum bleed orifice passage partially venting vacuum from induction manifold 17 to atmosphere, to limit peak vacuum applied to vapor separator 33 through line 41 from induction manifold 17. Passage 56 provides a flow restrictor passage limiting the volume of flow of fuel vapor from vapor separator 33 through line 41 to induction manifold 17. Fitting 50 limits fuel vapor supplied from vapor separator 33 to induction manifold 17 at peak vacuum from induction manifold 17 during rapid engine deceleration to prevent an overly rich fuel-air mixture in induction manifold 17 otherwise causing rough idling or stalling. The lower vacuum in vapor separator chamber 39 also reduces boiling and vapor bubbles. Fitting 50 also solves the above noted hot restart problem by reducing fuel foaming in vapor separator chamber 39 and limiting spillage of foamed fuel or the pumping of saturated fuel vapor into induction manifold 17.

The noted reduced diameter size of passage 57 is preferably chosen to limit vacuum in vapor separator chamber 39 to an upper limit of about 30 inches of water, which is about 2 inches of mercury. The noted reduced diameter size of passage 56 is chosen to provide sufficient fuel vapor flow at high engine speed. A large volume of fluid is pumped into vapor separator 33 by the engine bleed system through line 44 at high engine speeds. Volume flow through passage 56 of fitting 50 must be sufficient to prevent vapor separator 33 from becoming pressurized under these conditions.

Figure 4:
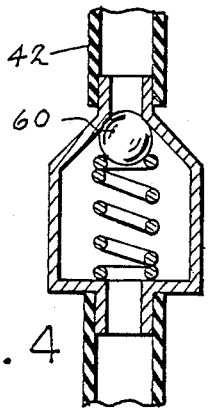
FIG. 4 shows another modification of the system of FIG. 1.

FIG. 4 shows another modification of the system of FIG. 1. A one-way check valve 60 is inserted in fuel line 42 between vapor separator 33 and inlet 30 of high pressure fuel pump 25. Valve 60 permits flow from vapor separator 33 to fuel pump 25, and blocks reverse flow. Some fuel contained in high pressure pump 25 may flash to vapor. Without valve 60, such vapor pushes the remaining liquid fuel out of pump 25 back through line 42 and into vapor separator 33. Valve 60 prevents such reverse flow.

It is recognized that various equivalents, alternatives and modifications are possible within the scope of the appended claims.

We claim:

1. A marine fuel system for an internal combustion engine having an induction system for supplying combustion air to the engine and fuel injection means for mixing fuel with the combustion air, and having a remote fuel tank, said fuel system comprising a first fuel pump connected to draw fuel from said tank and a second fuel pump connected to receive fuel from said first pump and provide fuel under pressure to said fuel injection means, a vapor separator connected between said first and second fuel pumps to remove fuel vapors supplied to said second pump, and a vapor supply line connected between said vapor separator and said induction system to supply the vapor removed from said fuel to said induction system, means connected in said vapor supply line limiting fuel vapor supplied from said vapor separator to said induction system at peak vacuum from said induction system during rapid engine deceleration to prevent an overly rich fuel-air mixture in said induction system otherwise causing rough idling or stalling, wherein said last mentioned means comprises in combination vacuum bleed orifice means in said vapor supply line partially venting vacuum from said induction system to atmosphere to limit the peak vacuum applied to said vapor separator from said induction system, and flow restrictor means in said vapor supply line limiting the volume of flow of fuel vapor from said vapor separator to said induction system, wherein said vacuum bleed orifice means and said flow restrictor means are at all times in continuous communication with each other and with said vapor separator and with said induction system.

2. A marine fuel system for an internal combustion engine having an induction system for supplying combustion air to the engine and fuel injection means for mixing fuel with the combustion air, and having a remote fuel tank, said fuel system comprising a first fuel pump connected to draw fuel from said tank and a second fuel pump connected to receive fuel from said first fuel pump and provide fuel under pressure to said fuel injection means, a vapor separator connected between said first and second fuel pumps to remove fuel vapors supplied to said second fuel pump, and a vapor supply line connected between said vapor separator and said induction system to supply the vapor removed from said fuel to said induction system, a fitting in said vapor supply line having first and second reduced diameter passages, said first passage in said fitting being a vacuum bleed passage partially venting vacuum from said induction system to atmosphere, to limit peak vacuum applied to said vapor separator from said induction system, said second passage in said fitting being a flow restrictor passage limiting the volume of flow of fuel vapor from said vapor separator to said induction system, to limit fuel vapor supplied from said vapor separator to said induction system at peak vacuum from said induction system during rapid engine deceleration to prevent an overly rich fuelair mixture in said induction system otherwise causing rough idling or stalling, wherein said first and second passages are at all times in continuous communication with each other and with said vapor separator and with said induction system.

3. A marine fuel system for an internal combustion engine having an induction system for supplying combustion air to the engine and fuel injection means for mixing fuel with te combustion air, and having a remote fuel tank, said fuel system comprising a first fuel pump connected to draw fuel from said tank and a second fuel pump connected to receive fuel from said first fuel pump and provide fuel under pressure to said fuel injection means, a vapor separator connected between said first and second fuel pumps to remove fuel vapors supplied to said second fuel pump, and a vapor supply line connected between said vapor separator and said induction system to supply the vapor removed from said fuel to said induction system, a fitting in said vapor supply line having first and second reduced diameter passages, said first passage in said fitting being a vacuum bleed passage partially venting vacuum from said induction system to atmosphere, to limit peak vacuum applied to said vapor separator from said induction system, said second passage in said fitting being a flow restrictor passage limiting the volume of flow of fuel vapor from said vapor separator to said induction system, to limit fuel vapor supplied from said vapor separator to said induction system at peak vacuum from said induction system during rapid engine deceleration to prevent an overly rich fuel-air mixture in said induction system otherwise causing rough idling or stalling, wherein said first passage is coaxial with and axially offset and spaced from said second passage.

4. The invention according to claim 3 wherein said diameter of said first passage is greater than said diameter of said second passage.

5. A marine fuel system for an internal combustion engine having an induction system for supplying combustion air to the engine and fuel injection means for mixing fuel with te combustion air, and having a remote fuel tank, said fuel system comprising a first fuel pump connected to draw fuel from said tank and a second fuel pump connected to receive fuel from said first fuel pump and provide fuel under pressure to said fuel injection means, a vapor separator connected between said first and second fuel pumps to remove fuel vapors supplied to said second fuel pump, and a vapor supply line connected between said vapor separator and said induction system to supply the vapor removed from said fuel to said induction system, a fitting in said vapor supply line having first and second reduced diameter passages, said first passage in said fitting being a vacuum bleed passage partially venting vacuum from said induction system to atmosphere, to limit peak vacuum applied to said vapor separator from said induction system, said second passage in said fitting being a flow restrictor passage limiting the volume of flow of fuel vapor from said vapor separator to said induction system, to limit fuel vapor supplied from said vapor separator to said induction system at peak vacuum from said induction system during rapid engine deceleration to prevent an overly rich fuel-air mixture in said induction system otherwise causing rough idling or stalling, wherein said reduced diameter of said first passage is sized to limit vacuum to an upper limit of about 30 inches of water, and wherein said reduced diameter of said second passage is sized to provide sufficient fuel vapor flow at high engine speed.

* * * * *